United States Patent [19]

Sabin

[11] Patent Number: 4,752,211

[45] Date of Patent: Jun. 21, 1988

[54] FLOW PROPORTIONING SYSTEM

[76] Inventor: Darrel B. Sabin, 2800 N. First St., Martin, Ohio 43445

[21] Appl. No.: 906,976

[22] Filed: Sep. 12, 1986

[51] Int. Cl.[4] ..... F23N 1/02

[52] U.S. Cl. ..... 431/90; 431/12; 137/164

[58] Field of Search ..... 431/12, 90; 236/15 BD; 137/98, 100, 164, 165

[56] References Cited

U.S. PATENT DOCUMENTS

| | | | |
|---|---|---|---|
| 2,072,882 | 3/1937 | Wunsch | 137/164 |
| 2,341,177 | 2/1944 | Cope | 137/165 |
| 2,536,678 | 1/1951 | Coe | 137/165 |
| 2,799,288 | 7/1957 | Knight | 431/90 X |
| 4,097,219 | 6/1978 | Prowald | 431/90 |

FOREIGN PATENT DOCUMENTS

| | | | |
|---|---|---|---|
| 0620947 | 8/1978 | U.S.S.R. | 431/90 |

*Primary Examiner*—Margaret A. Focarino

*Attorney, Agent, or Firm*—Emch, Schaffer, Schaub & Porcello

[57] ABSTRACT

A method and apparatus for maintaining the flow rate of one or more secondary fluids proportional to the flow rate of a primary fluid is disclosed. A valve is located in a primary fluid line and a valve is located in a secondary fluid line. An actuator drives linkage to operate the valves in approximate proportion to one another. A sensor senses the fluid pressure in the primary line and the sensed pressure is delivered to each regulator in the secondary lines. The regulators adjust the static pressures of the secondary fluids downstream of the valves to the desired proportional level.

6 Claims, 1 Drawing Sheet

FLOW PROPORTIONING SYSTEM

BACKGROUND OF THE INVENTION

The invention is directed to maintaining the flow rate of one or more fluids proportional to the flow rate of another fluid. For example, the most common method used in the industrial heating industry for controlling air/fuel ratio of modulating-input burners is the balanced-pressure fuel regulator, supplied with a constant, fixed, upstream pressure. The balanced-pressure regulator is cross-loaded from the combustion air line, so that the outlet static pressure of the regulator is equal to the static pressure of the combustion air line supplying the burner or burners. This system works very well, provided that the minimum input to the burner or burners supplied by the regulator does not exceed about one-tenth of the maximum input to the burner or burners. The ratio of maximum input to minimum input is called turndown.

However, some burners have the capability of turndowns of more than 10 to 1. The use of the prior art fuel control system described above with burners having turndowns of more than 10 to 1 presents a difficult control problem because, with a constant upstream fuel pressure, the opening required of the balanced-pressure regulator becomes so small at the very low flows that the regulator becomes unstable.

Accordingly, it is an object of the present invention to provide a novel and improved method and apparatus for maintaining the static pressure level and flow rate of one or more (secondary) gases or liquids (fluids) proportional to the static pressure level and flow rate of another (primary) gas or liquid (fluid). It is understood that as used in the present specification and claims the term "proportional" includes "equal".

SUMMARY OF THE INVENTION

The present invention relates to a method and apparatus for maintaining the static pressure levels and flow rates of two or more fluids to be proportional to one another.

One embodiment of the present invention utilizes mechanically-linked valves to cause the static pressure levels and flow rates of two or more fluids to be approximately proportional to one another. Further, it utilizes a regulator, located downstream of one of the said valves, in the line supplying the secondary fluid, to make the flow rate of the secondary fluid exactly proportional to the flow rate of the primary fluid; that is, to correct for any non-proportional flow condition of the secondary fluid permitted by the linked valves. By varying the inlet static pressure of the secondary fluid to the regulator inlet in approximate proportion to the static pressure of the primary fluid, the length of the excursion required of the regulator valve is greatly reduced. Fluid flow rate turndowns of 50 to 1, or more, are achieved while maintaining the proportionality of the flows. Any number of secondary fluids may have their flow rates held proportional to the flow rate of the primary fluid.

DETAILED DESCRIPTION OF THE ILLUSTRATED EMBODIMENT

Figure 1:
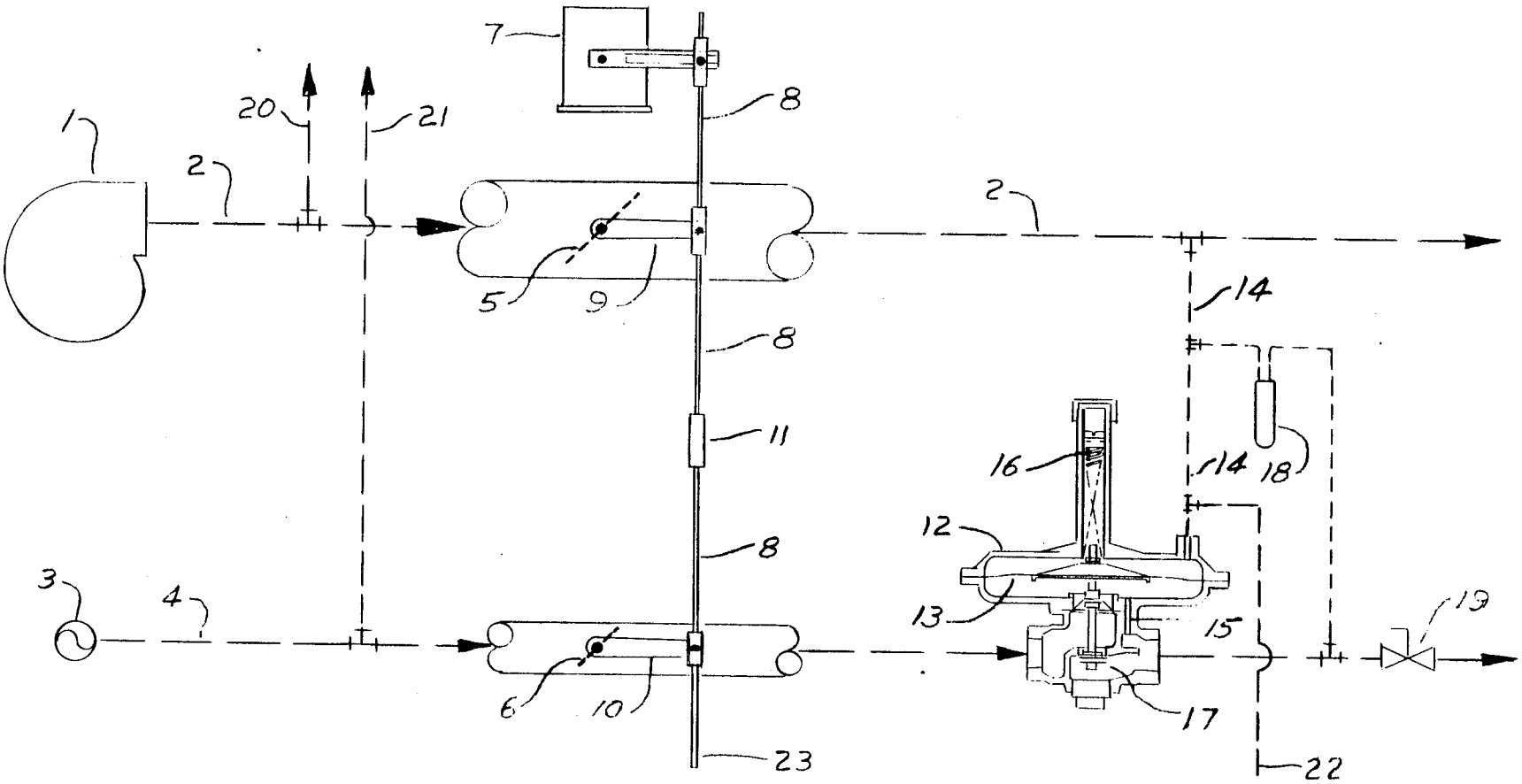
FIG. 1 is a schematic drawing of an embodiment of the present invention.

Referring now to FIG. 1 in which, for the purposes of illustrating the principles of the invention, combustion air is the primary fluid and fuel gas is the secondary fluid. The two fluids are directed, for the purpose of illustration, to one or more burners.

A blower 1 supplies combustion air (primary fluid) to the burners via a combustion air line 2. A fuel gas source 3 supplies fuel gas (secondary fluid) to the burners via a fuel gas line 4. A valve 5, for example a damper valve, in the combustion air line 2, and a valve 6 in the fuel gas line 4, are linked to an actuator 7 via linkage 8. The linkage 8 is connected to valve torque arms, 9 and 10, respectively. The torque arm 9 operates the valve 5 and the torque arm 10 operates the valve 6. A turnbuckle 11 provides adjustment between the valve 5 and 6.

The flow of combustion air and fuel gas to the burners is increased or decreased by the actuator 7 driving the valves 5 and 6 concurrently. If the combustion air flow control valve 5 and the fuel gas control valve 6 were perfectly matched, the flow of fuel to the burners would be proportional to the combustion air flow to the burners and no further controls would be required. However, in practice, the valves cannot be perfectly matched. For this reason, a regulator 12 is positioned in the system.

The static pressure of the combustion air, downstream of the valve 5, is directed to the top of a diaphragm 13 of a regulator 12 by a sensing line 14 which is connected to the combustion air line 2. The bottom side of the regulator diaphragm 13 is loaded internally via a port 15, or may be loaded externally, from the static pressure of the fuel gas line 4. The regulator 12 has an internal tension spring 16 that serves to counterbalance the weight of the moving parts of the regulator 12. Some regulator manufacturers use a compression spring to counterbalance the weight of the moving regulator parts. In that case, the regulator is mounted with the spring housing pointing downward. If the static pressure of the secondary fluid is not to be equal to the static pressure of the primary fluid, but is to be proportional in the static pressure in other than a 1:1 basis the regulator is spring-loaded accordingly.

As the flow of combustion air and fuel gas to the burners is increased or decreased by the actuator 7 driving the valves 5 and 6, the static pressures of the combustion air and fuel gas downstream of the valves 5 and 6, respectively, increase or decrease. If both combustion air and fuel gas static pressures, downstream of the valves 5 and 6, remain proportional regardless of the positions of the valves 5 and 6, the regulator valve 17 will remain in one position because no compensation to the secondary flow is required.

Because the flow vs. pressure drop characteristics of the valves 5 and 6 are not likely to be exactly equal, the regulator 12 serves to increase or decrease the flow rate of the fuel gas, as required to achieve proportional static pressures. For the purpose of illustration, assume that the regulator 12 is designed to control its outlet pressure equal to its loading pressure. If the fuel gas static pressure, as sensed by the internal regulator port 15 and directed to the bottom of the regulator diaphragm 13, is higher than the combustion air loading pressure directed to the top of the regulator diaphragm 13, then the regulator valve 17 moves slightly up, or toward its closed position, until the pressure on bottom of the regulator diaphragm 13 equals the loading pressure on the top of the same diaphragm 13. The reverse is true if the fuel gas static pressure is less than combustion air static pressure. Thus, the regulator serves to maintain the static pressure of the secondary (fuel gas) fluid equal to the static pressure of the primary (combustion air) fluid. Because the static pressure of the fuel gas at the regulator inlet is being varied with the static pressure of the combustion air, very little movement of the regulator valve 17 is required.

A manometer 18, has one side connected to the combustion air loading line 2 and the other side connected to sense the fuel gas static pressure downstream of the regulator 12. If the regulator 12 is designed so that its outlet pressure is equal to its loading pressure, the manometer 18 will always show zero differential pressure, regardless of the level of combustion air pressure, indicating that the fuel gas static pressure is equal to the combustion air static pressure.

An adjustable orifice 19 serves to control the ratio of fuel gas flow to combustion air flow by inserting an additional pressure drop in the fuel gas system.

A combustion air line 20 and a fuel gas line 21 supply burners in other heating zones.

Sensing line 22 delivers the static pressure signal from the primary fluid line 2 to other secondary fluid line regulators, if any. The mechanical linkage 23, extending from the linkage 8, connects control valves in other secondary fluid lines, if any.

Because the pressure drops of both the combustion air and fuel gas systems, downstream of the static pressure control system described above, are assumed to be fixed or, if varying, proportional, the maintenance of the static pressure of the secondary fluid proportional to the static pressure of the primary fluid results in the flow rate of the secondary fluid being proportional to the flow rate of the primary system, the fluid temperatures being constant.

One advantage of this system is that, since the fuel gas static pressure upstream of the regulator 12 is reduced approximately at the same rate as the combustion air static pressure, the regulator 12 is required to move its internal valve only enough to compensate for the non-proportionality of the linked valves, even at very low flows; thus no regulator instability occurs.

The system described above is applicable to any number of secondary flow systems containing fluids whose static pressures can be controlled by regulators. The fluids, primary or otherwise, may consist of any gas or liquid whose static pressure can be controlled by a regulator.

Having thus described my invention, what I claim as new and desire to protect by Letter Patent is:

What I claim:

1. A flow proportioning system comprising, in combination, a primary fluid line, a valve for said primary line, at least one secondary fluid line, a valve for said secondary line, linkage means operatively connected to both said primary valve and said secondary valve for simultaneously opening and closing said primary valve and said secondary valve, an actuator means connected to said linkage means for driving said linkage means and operating said primary valve and said secondary valve in direct proportion to one another, a regulator operatively connected to said primary line and said secondary line, said regulator being located downstream of said secondary valve, sensing means in communication with said primary line for communicating a sensed static pressure to said regulator, said sensing means being located downstream of said primary valve, and discharge means operatively connected to said regulator for discharging a pressurized fluid to said secondary line, whereby the flow rates of said primary fluid and said secondary fluid are proportional to one another.

2. A flow proportioning system for supplying a burner apparatus comprising, in combination, a combustion air line, an air valve for said air line, a fuel gas line, a fuel valve for said fuel line, control means operatively connected to both said combustion air valve and said fuel gas valve for simultaneously opening and closing said combustion air valve and said fuel gas valve, an actuator means connected to said control means for operating said combustion air valve and said fuel gas valve in direct proportion to one another, a regulator connected to said fuel gas line, said regulator being located downstream of said fuel valve, sensing means in communication with said combustion air line for communication a sensed pressure to said regulator, said sensing means being located downstream of said combustion air valve, and discharge means operatively connected to said regulator for discharging a pressurized fluid to said fuel gas line, whereby the flow rates of said combustion air and said fuel gas are proportional to one another.

3. An air/fuel flow proprotioning system for supplying a burner apparatus comprising, in combination, a combustion air line, an air valve for said air line, a fuel gas line, a fuel valve for said fuel gas line, linkage means operatively connected to both said air valve and said fuel valve for simultaneously opening and closing said air valve and said fuel valve, an actuator means connected to said linkage means for driving said linkage means and operating said air valve and said fuel valve in direct proportion to one another, a regulator operatively connected to said fuel gas line, said regulator being located downstream of said fuel valve, sensing means in communication with said combustion air line for communicating a sensed pressure to said regulator, said sensing means being located downstream of said combustion air valve, and discharge valve means operatively connected to said regulator for discharging pressurized fuel gas to said fuel gas line, whereby the flow rates of said combustion air and said fuel gas are proportional to one another.

4. An air/fuel flow proportioning system according to claim 3 including a control valve downstream of said regulator for increasing or decreasing the pressure drop by a fixed amount.

5. An air/fuel flow proportioning system according to claim 3, wherein said regulator comprises a balanced-pressure diaphragm regulator.

6. An air/fuel flow proportioning system according to claim 5, wherein said sensing means comprises a conduit extending between said combustion air line and said diaphragm regulator and wherein said discharge valve means is in communication with said fuel gas line and operatively connected to the diaphragm of said diaphragm regulator.

* * * * *